US007328986B2

(12) United States Patent
Wang

(10) Patent No.: US 7,328,986 B2
(45) Date of Patent: Feb. 12, 2008

(54) INKJET PRINTER INK CARTRIDGE

(76) Inventor: Alex Kuo-Shen Wang, 8658 Panuco Way, Las Vegas, NV (US) 98147

( * ) Notice: Subject to any disclaimer, the term of this patent is extended or adjusted under 35 U.S.C. 154(b) by 234 days.

(21) Appl. No.: 10/767,159

(22) Filed: Jan. 28, 2004

(65) Prior Publication Data

US 2005/0162489 A1 Jul. 28, 2005

(51) Int. Cl.
*B41J 2/175* (2006.01)

(52) U.S. Cl. ..... 347/86; 347/84; 347/85

(58) Field of Classification Search ..... 347/86, 347/84, 85

See application file for complete search history.

(56) References Cited

U.S. PATENT DOCUMENTS 5,477,963 A * 12/1995 Mochizuki et al. ..... 206/701
5,583,549 A * 12/1996 Ujita et al. ..... 347/86
6,186,620 B1 * 2/2001 Hsieh et al. ..... 347/84
6,276,788 B1 * 8/2001 Hilton ..... 347/86
6,619,789 B2 * 9/2003 Childers et al. ..... 347/85
2003/0107626 A1 * 6/2003 Qingguo et al. ..... 347/86

FOREIGN PATENT DOCUMENTS

EP 1270235 A1 * 1/2003

* cited by examiner

*Primary Examiner*—Manish S. Shah
*Assistant Examiner*—Laura E. Martin
(74) *Attorney, Agent, or Firm*—Pre-Techter Int'l Services

(57) ABSTRACT

An inkjet printer ink cartridge, which improves upon the ink cartridge of a conventional inkjet ink cartridge, whereby need for sponge within the ink cartridge is eliminated, and a siphon device is configured within the ink cartridge. The ink cartridge utilizes a siphoning phenomenon to prevent leakage of ink from contact area of a nozzle of the inkjet printer and from an area of the siphon. Reusability of the ink cartridge is realized without affecting quality of printing of the ink cartridge, and without causing problems in environmental protection recovery.

4 Claims, 6 Drawing Sheets

INKJET PRINTER INK CARTRIDGE

BACKGROUND OF THE INVENTION (a) Field of the Invention

The present invention relates to an ink refill structure for an inkjet printer ink cartridge, and more particularly to the ink cartridge that eliminates need for any sponge to be used as material for the ink cartridge. The ink cartridge utilizes a siphoning phenomenon to realize reusability of the ink cartridge without affecting quality of printing of the ink cartridge, and without causing problems in.

(b) Description of the Prior Art

Referring to FIG. 1, which shows an ink cartridge 100 of a general inkjet printer having a sponge 200 packed within the ink cartridge 100, and wherewith capillarity of the sponge 200 is utilized to supply a steady and even quantity of ink to a nozzle of the printer. However, because of inability of the ink cartridge 100 to be reused, the ink cartridge 100 must be disposed of after the ink within is depleted. Even though a user can reluctantly re-inject ink into the ink cartridge 100, repeated injecting of ink will slowly cause deterioration of the sponge 200, and thus influence print quality of the ink cartridge 100, resulting in inability to reuse. As a consequence the Ink cartridges 100 are disposed of in considerable quantities, bringing about serious problems in environmental protection recovery.

SUMMARY OF THE INVENTION

A primary objective of the present invention is to redesign a structure of an ink cartridge, whereby an equilibration tube is configured within an ink receptacle of the ink cartridge, and utilizes a principle of a siphoning phenomenon. The ink cartridge thereby eliminates need for any sponge to be used as material for the ink cartridge, and achieves reusability of the ink cartridge without affecting quality of printing of the ink cartridge, and without causing problems in environmental protection recovery.

Another objective of the present invention is to utilize volume otherwise taken up by the sponge within the conventional ink cartridge and replace with ink, thus enabling even more ink to be filled within the ink cartridge, and thereby realizing the printing of an even greater number of sheets of paper from each usage of the ink cartridge.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
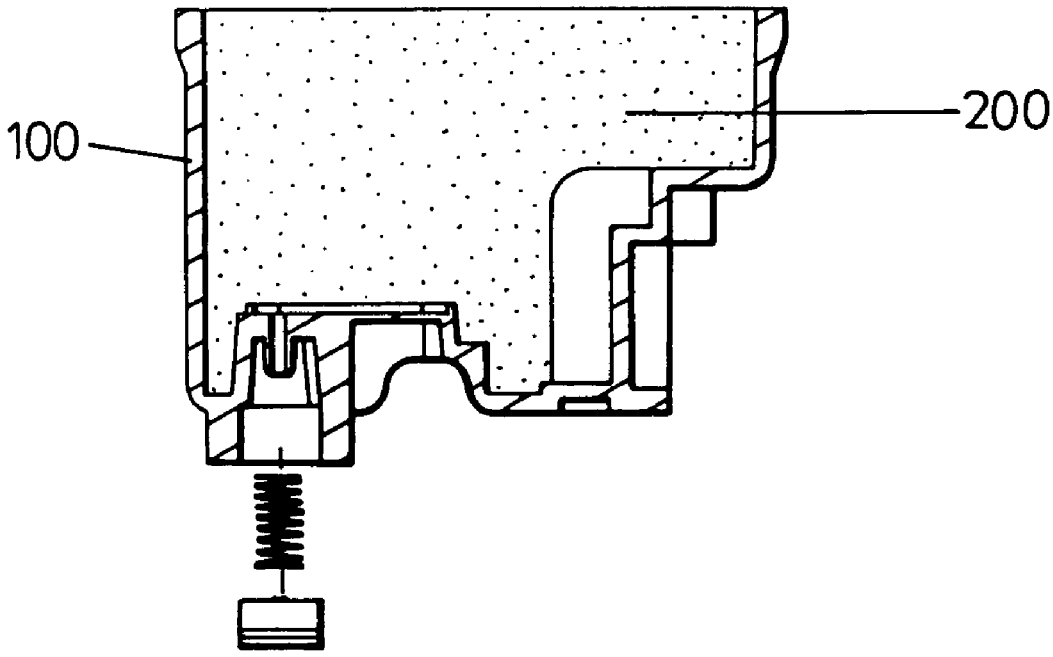
FIG.1 (PRIOR ART)
FIG. 1 shows a cross sectional schematic view of a conventional product.
Figure 2:
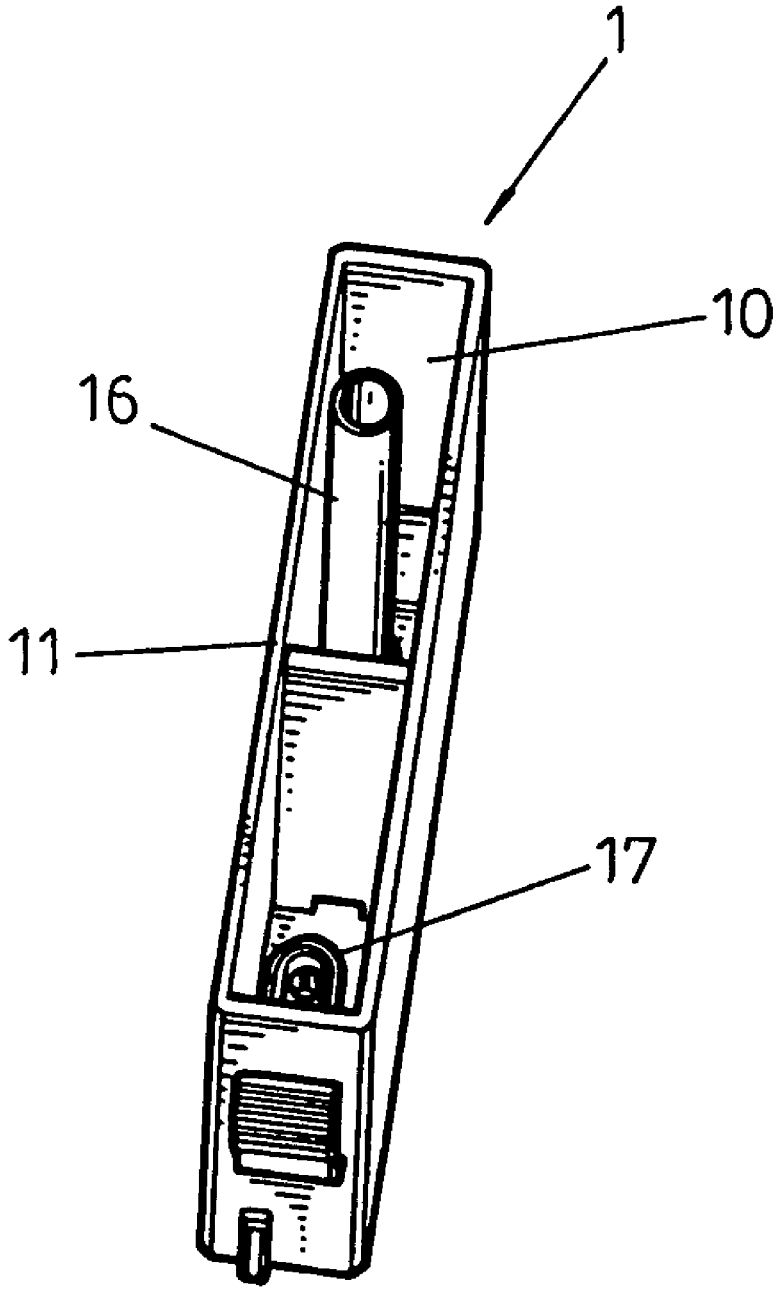
FIG. 2 shows a general view according to the present invention.
Figure 3:
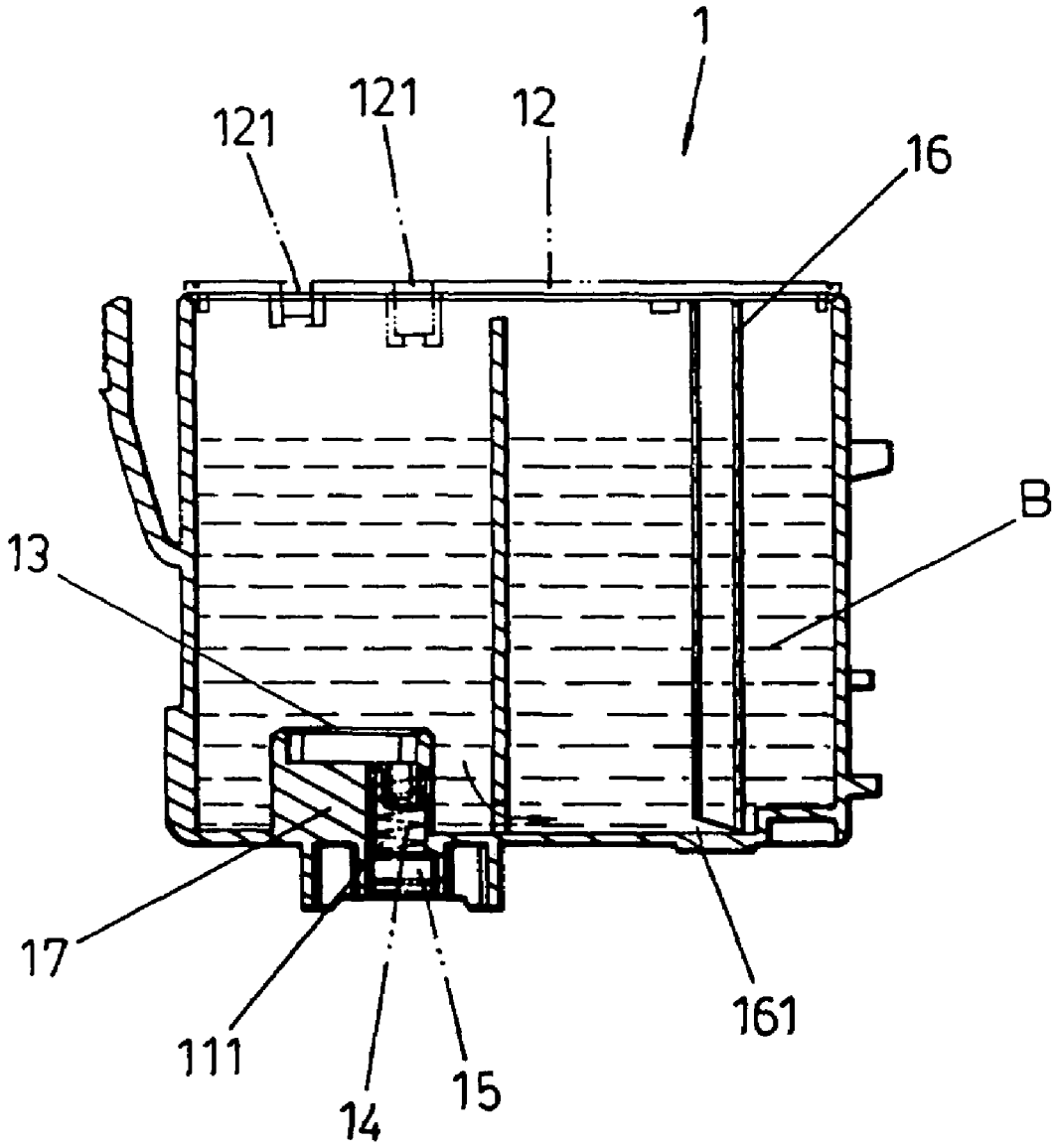
FIG. 3 shows a cross sectional view according to the present invention.

Referring to FIGS. 2 and 3, which show an ink cartridge 1 of the present invention assembled to primarily comprise a plastic case 11, a top cover 12, a strainer 13, a spring 14 and a rubber washer 15. The aforementioned structural elements are made from material that is resistant to deterioration from ink, and can be reused without affecting print quality of the ink cartridge 1. Wherein ink B is injected into a receptacle 10 of the ink cartridge 1 through ink inject holes 121 of the top cover 12 (upon injecting the ink B, the ink inject hole inks 121 are re-sealed). The strainer 13 is configured in a bottom of the receptacle 10, and a groove 111 below the strainer 13 provides for configuring the spring 14 and the rubber washer 15 therein, as well as connecting to a nozzle area of the printer. The present invention is characterized in that:

A equilibration tube 16 is configured within the ink receptacle 10 of the ink cartridge 1, at the bottom of the ink receptacle 10 an inclined opening 161 of a lower extremity of the equilibration tube 16 realizes a mutual passage with the ink receptacle 10 and provides for ink B within the ink receptacle 10 to enter the equilibration tube 16 therein, while an upper extremity of the equilibration tube 16 realizes a mutual passage with the atmosphere external to the ink cartridge 1. Referring to FIG. 3, which shows that when ink level B within the ink receptacle 10 is higher than level of the strainer 13, due to equilibration tube principle, leakage of the ink B from the rubber washer 15 of the ink cartridge 1 in contact with the nozzle area is prevented. Furthermore, the ink B will not spill from the equilibration tube 16. When the ink level of the ink B within the ink receptacle 10 is lower than the level of the strainer 13, the equilibration tube principle does not come into effect. However, the strainer 13 is supported by a retaining wall 17 that counterchecks the ink B from leaking out of the nozzle contact area, as well as preventing spillage of ink from the equilibration tube 16.

Figure 4:
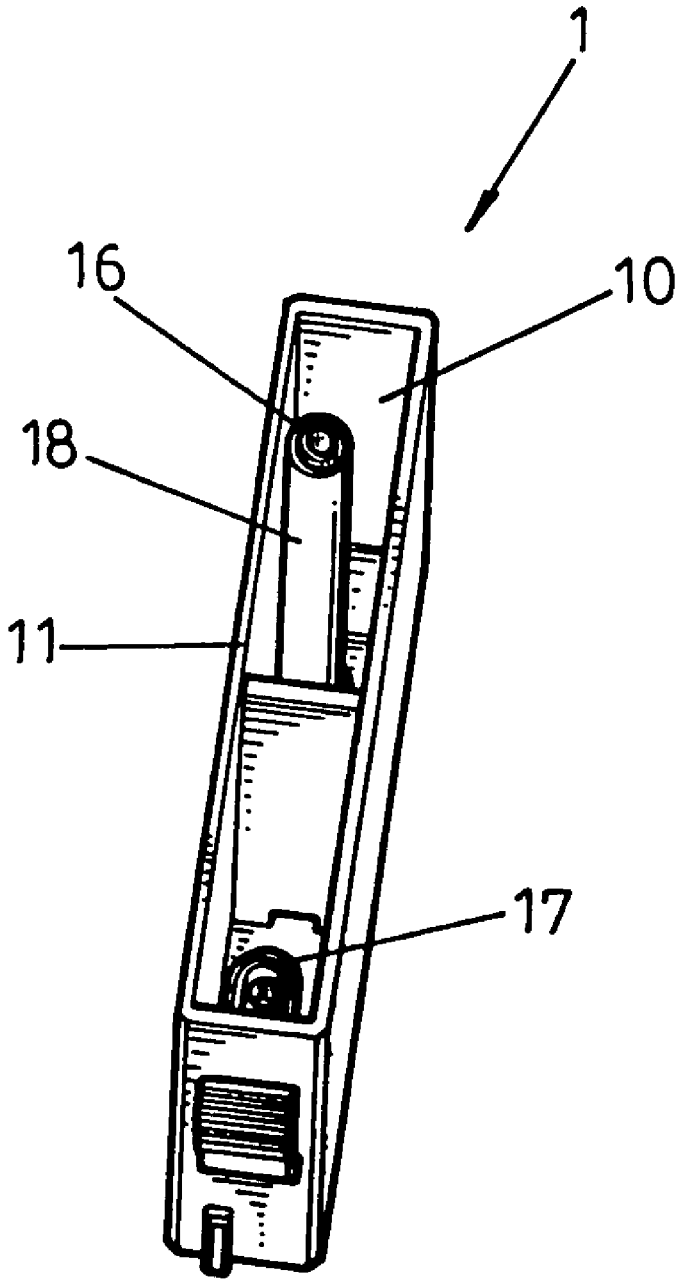
FIG. 4 shows a general view of an embodiment according to the present invention.
Figure 5:
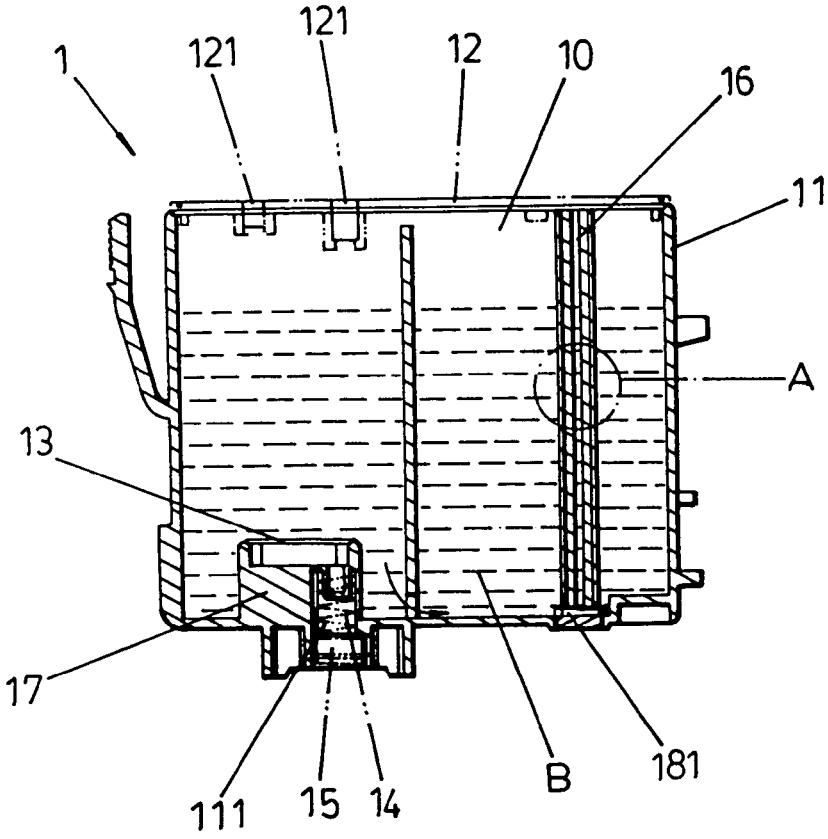
FIG. 5 shows a cross sectional view of the embodiment according to the present invention.
Figure 6:
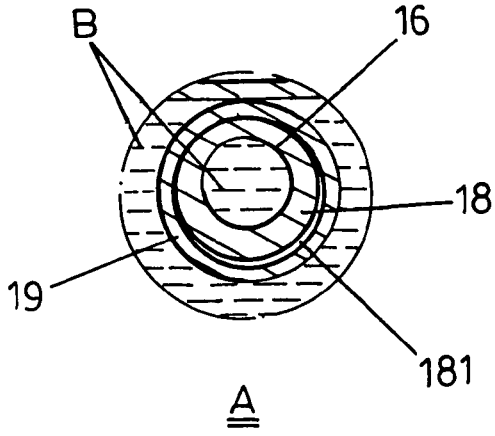
FIG. 6 shows a cutaway view of FIG. 5 along A-A line according to the present invention.

Referring to FIGS. 4, 5, and 6, which show the equilibration tube 16 of the present invention can be additionally periphally configured to be eccentric to theequilibration tube 16, th ereby resulting in an air hole 181, moreover, realuizes a mutual passage with the equilibration tube 16.

Figure 7:
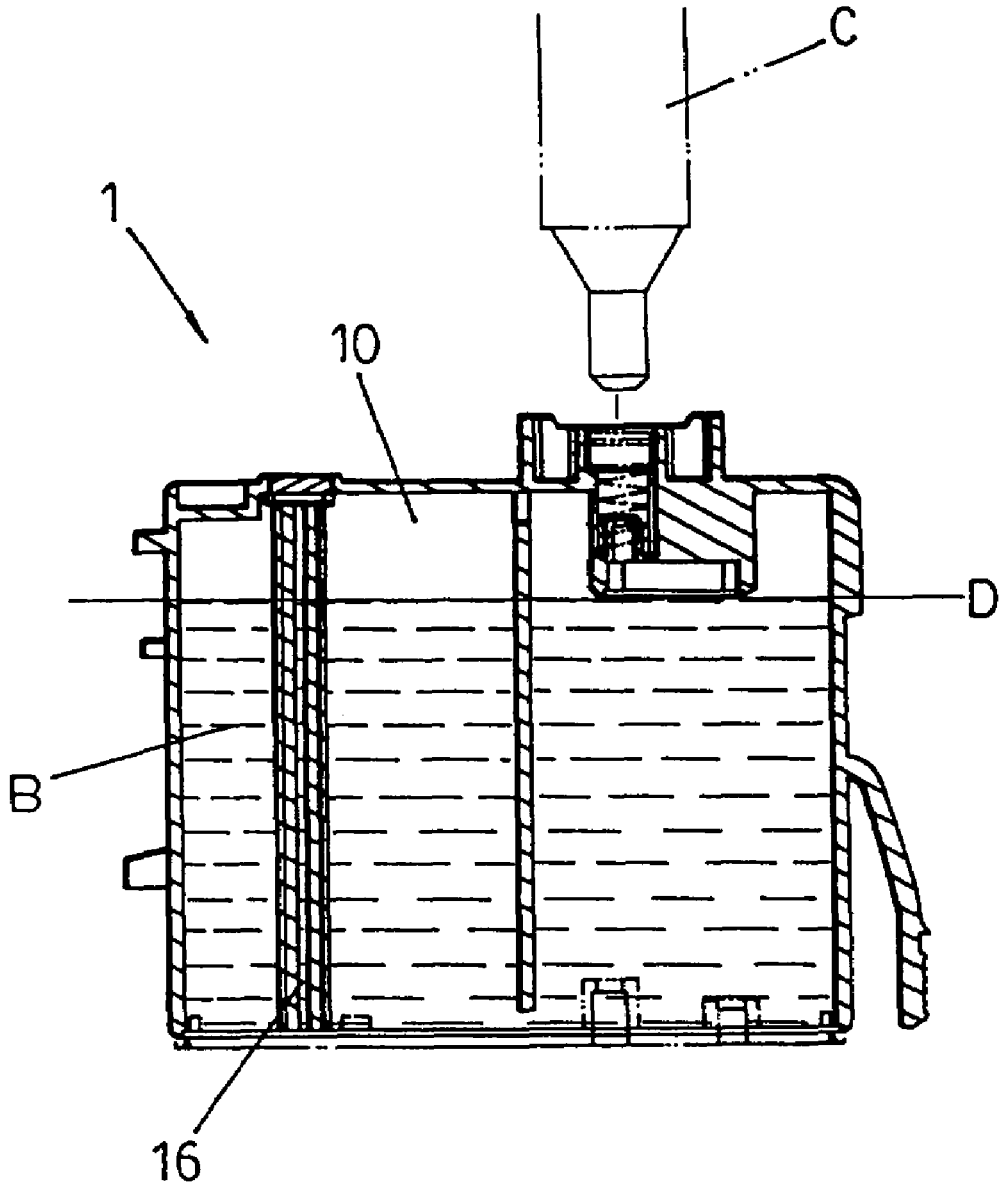
FIG. 7 shows a cross sectional schematic view of ink refilling according to the present invention.

Referring to FIG. 7, which shows a method for refilling the ink B, whereby the ink cartdrige 1 is first retrieved from the printer and placed upside down. An ink fillling instrument C having a syringe shape is utilized to slowly inject the ink B into the ink receptacle 10 through an ink refill hole of the rubber washer 15 that contacts the nozzle, and the ink B is continually injected until the ink B approaches a refill line D, whereupon refilling is stopped, thus preventing the ink B from spilling out of the equilibration tube 16. In addition, because the ink cartridge 1 is made from transparent plastic, therefore a user is able to clearly see the level of filling ink, and thereby know when the ink B approaches the refill lline D.

In conclusion, because the ink cartridge 1 of the present invention does not utilize any sponge as material for the ink cartridge 1, therefore the ink cartridge 1 can be refilled with an even greater quantity of ink B therein (by utilizing the volume otherwise taken up by the sponge within the conventional ink cartridge), thereby realizing the printing of an even greater number of sheets of paper from each usage of the ink cartridge 1. Furthermore, the ink cartridge 1 can be repeatedly refilled and reused without affecting quality of printing of the ink cartridge, and without causing problems in environmental protection recovery.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An inkjet printer ink cartridge comprising:

an ink cartridge body having a plastic ink receptacle, a top cover, a strainer, a spring and a rubber washer;

a strainer support elevated from a bottom of the ink receptacle by a retaining wall with a recess below said strainer adapted to receive said spring and said rubber washer, being further adapted to connect to a nozzle area of a printer; and a equilibration tube configured within said ink receptacle of said ink cartridge body, extending from the top of the ink receptacle to the bottom, having an opening at the bottom for fluid communication at the bottom of said ink receptacle, and connected at the top of said ink receptacle to a passage in two-way fluid communication with the atmosphere external to the ink receptacle;

wherein ink can be refilled into said ink receptacle of said ink cartridge body.

2. The inkjet printer ink cartridge according to claim 1, wherein the strainer is supported by a retaining wall, such that when ink level within the ink receptacle is lower than level of the strainer, the retaining wall helps prevent the ink from leaking out.

3. The inkjet printer ink cartridge according to claim 1, wherein the equilibration tube can be additionally peripherally configured with an inner tube and an outer tube, whereby an air hole is formed between the inner tube and the outer tube, and the air hole realizes a mutual passage with the equilibration tube.

4. The inkjet printer ink cartridge according to claim 1, wherein said recess in said strainer support is further adapted to receive refill ink injected into the ink receptacle by means of an ink filling instrument, and which refill ink is injected until the ink approaches a refill line, whereupon refilling is stopped.

* * * * *